United States Patent [19]

Bassouls

[11] Patent Number: 4,894,888

[45] Date of Patent: Jan. 23, 1990

[54] DEVICE FOR TEMPORARILY CONNECTING THE ENDS OF TWO STRUCTURES OF WHICH AT LEAST ONE IS FLEXIBLE

[76] Inventor: Pierre H. Bassouls, 7 rue du Boeuf, 69005 Lyon, France

[21] Appl. No.: 202,968

[22] Filed: Jun. 6, 1988

[30] Foreign Application Priority Data

Jun. 5, 1987 [FR] France ..... 87 08101

[51] Int. Cl.[4] ..... A44B 19/10

[52] U.S. Cl. ..... 24/400; 160/393

[58] Field of Search ..... 24/704.1, 399, 400, 24/462, 587; 52/222, DIG. 11, 63; 4/503, 496, 506; 160/383, 391, 392, 393, 396, 401

[56] References Cited

U.S. PATENT DOCUMENTS

| | | | |
|---|---|---|---|
| 1,956,319 | 5/1934 | Spe | 24/400 |
| 3,234,614 | 2/1966 | Plummer | 24/400 |
| 4,035,875 | 7/1977 | Kobelt | 24/587 |
| 4,158,244 | 6/1979 | Stefan | 160/391 X |

FOREIGN PATENT DOCUMENTS

| | | | |
|---|---|---|---|
| 406789 | 12/1934 | Belgium . | |
| 2336733 | 2/1975 | Fed. Rep. of Germany . | |
| 473954 | 2/1915 | France . | |
| 718023 | 1/1932 | France . | |
| 1072065 | 9/1954 | France . | |
| 65785 | 1/1973 | Luxembourg . | |
| 244328 | 4/1947 | Switzerland . | |
| 685008 | 12/1952 | United Kingdom | 24/400 |
| 860238 | 2/1961 | United Kingdom . | |
| 1150784 | 4/1969 | United Kingdom . | |
| 1518095 | 7/1978 | United Kingdom . | |
| 1600238 | 10/1981 | United Kingdom . | |

*Primary Examiner*—James R. Brittain

*Attorney, Agent, or Firm*—Wall and Roehrig

[57] ABSTRACT

This invention relates to a device for temporarily connecting the ends of two structures of which at least one is flexible and comprises over its length a bead adapted to be introduced inside a gutter provided along the second structure, wherein the gutter is constituted by an open section inside which are disposed, over the whole of its length, two tongues between which is a gap smaller than the thickness of the bead and which presents a certain flexibility enabling their ends to be moved apart from each other under the action of a pressure, stops being provided inside the gutter in order, on the contrary, to avoid any spacing apart during a traction. The introduction of the bead and removal thereof is obtained by means of a slide element movable along the gutter.

9 Claims, 10 Drawing Sheets

DEVICE FOR TEMPORARILY CONNECTING THE ENDS OF TWO STRUCTURES OF WHICH AT LEAST ONE IS FLEXIBLE

FIELD OF THE INVENTION

The present invention relates to an improved device for ensuring temporary connection of the ends of two structures of which at least one is flexible, the connection between said ends being made over the whole of their length and the separation from each other being able to be progressive, rapid and without effort by the user.

BACKGROUND OF THE INVENTION

Up to the present time, when it was desired to connect the ends of two structures, of which one is flexible, for example the end of a tarpaulin for covering a lorry on the edge of the side panel that the transporting platform comprises, the end of a mobile blind, of a glasshouse cover, the lower edges of big tops or emergency shelters, of wall fabrics, of two parts of a garment . . . , various types of joining elements have been proposed.

For example, in the case of fixing a flexible cover to a rigid structure, the following means are conventionally employed:

systems employing eyelets, hooks and elastic members which present the drawbacks of not ensuring great tightness and especially of having a mediocre resistance in the case of lateral loads, being given that the tension is not distributed uniformly along the fixation; furthermore, such systems are not practical to unfold and cannot be rendered automatic;

fixations employing a section in the form of a gutter on which is engaged a flexible bead connected to the end of the flexible structure to be fixed. Such a type of fixation, employed in particular in the domain of camping, for example in the case of caravan canopies, dismantling of big tops, presents the advantage of having a good tensile strength and a good tightness, but, when the flexible element (or cover) is of great length, maneuvering is delicate in view of the very considerable frictions. Moreover, the end opposite the flexible element (cover) must be dismantled simultaneously, which precludes certain applications, such as for example the covering of a lorry;

the fixation of the "curtain rail" type (rail connected to the cover) which, although it is practical to use and may be rendered automatic, presents the drawback of not allowing the part opposite the cover to be left in place, this eliminating certain applications, and, furthermore, as the tension is not uniformly distributed along the cover, concentrations of stresses are produced at the level of fastening of the roller. Moreover, this type of fixation cannot be used when the cover must be totally removed (the latter can be rejected only at the end of the rail).

If it is desired to connect together two flexible structures, the most wide-spread device is the so-called "slide fastener" of which the two elements are borne along each of the edges of the grooved structures. Such slide fasteners which comprise metal teeth fitting in one another under the action of a slide element, are complex and expensive to manufacture. Furthermore, their aesthetic appearance is a debatable point and when one of the teeth is twisted, such an assembly is no longer reliable. To overcome this drawback, it has been proposed to produce slide fasteners operating by fitting of two flexible sections in each other. This type of closure is used in particular for hermetically closing plastic packings. However, this solution presents the major drawback of offering only a mediocre tensile strength, which renders it inappropriate for numerous uses.

A simple device, which is economical to manufacture and easy to employ, has now been found, and this forms the subject matter of the present invention, which overcomes all these drawbacks.

SUMMARY OF THE INVENTION

The invention therefore generally relates to a device for temporarily connecting the ends of two structures, of which at least one is flexible and comprises, over the whole of its length, a bead adapted to be introduced inside a gutter provided along the second structure and it is characterized in that:

said gutter is in the form of an open section inside which are disposed, over the whole of its length, two preferably symmetrical tongues, between which is a gap smaller than the thickness of the bead, said tongues presenting a certain flexibility making it possible to move their ends away from each other under the action of a pressure, stops (supports) being provided inside the gutter in order, on the contrary, to avoid any spacing apart during a traction;

the introduction of the bead inside the section and its removal therefrom for disconnection is obtained by means of a slide element movable along the gutter and which comprises a curved envelope at least partially enveloping the bead and allowing the flexible structure to pass and, during its displacement, making it possible, in one direction, to move the tongues apart from each other in order to introduce said bead below the tongues inside the gutter during connection and, in the other direction, to remove it during disconnection.

Such a device presents numerous advantages, for example:

a tensile strength which, further to the correct dimensioning of one of the components of the device, may equal the tensile strength of the flexible cover used;

simple and easy handling which, in addition, may be rendered automatic, being given that the slide tool slides along a section;

it is not necessary to dismantle simultaneously the two opposite sides of the cover, the movement of the slide tool alone causing the passage from the "free" state to the "fixed" state;

the possibility of disconnecting the flexible element from the other structure, particularly when it is rigid, by providing a groove at the end of the section, with the result that, at the end of opening, said slide element may be removed from the section. In such a case, said slide element is preferably connected to a flexible bead fixed on the border of the cover, and may either remain connected to the bead, therefore to the cover, or be removed for purposes of use for other portions of fixation as a function of the configuration chosen;

the cover is subjected to a uniform tension, being given that the supporting surfaces are distributed continuously along the section and there is therefore no concentration of stresses on the cover, this increasing long-life of such an assembly.

Advantageously, and in practice, according to the invention:

the section performs, inter alia, the function of guiding the slide tool and may, either be secured to the second structure, for example by bolting or riveting, or may constitute the structure itself;

the bead fixed to the border of the flexible cover is preferably cylindrical; of course, other shapes may be envisaged;

as stated hereinabove, inside the section are disposed two advantageously symmetrical tongues which leave over their whole length a gap smaller than the bead; these two tongues may be disposed so as to make an angle of about 45° with the horizontal, this making it possible to reject the point of fixation inside the section as well as to reduce the width of the fixation; the characteristics of flexibility of the tongues will be a function of the applications envisaged, but in general, they will present a sufficiently large length with respect to their thickness to obtain a sufficient deflection, whilst remaining in the elastic domain, when they are moved apart in order to introduce the bead and not to break when, on the contrary, said bead is released, whilst ensuring a very high tensile strength, disconnection being possible only thanks to the slide tool which makes it possible to release the bead below the level of the two tongues by causing the latter to bend in the direction where the supports (stops) do not act;

the slide tool whose function is to move the two tongues apart, causing them to bend downwardly, also serves to guide the bead so as to bring it below the level of the two tongues. In order to prevent the tongues from taking a sufficient deflection allowing release of the bead in the case of considerable forces exerted on the cover, two supports are preferably provided inside the outer section. These supports are advantageously made with rounded ends, this making it possible to reduce the risks of rupture of the tongues by fatigue. The space between the supports (stops) is generally clearly greater than the thickness of the bead in order to allow it to be introduced between the tongues;

the slide tool is constituted by one or more guiding portions connected to a tube of which the inner shape envelopes the bead used; this tube, bent at two points, makes it possible to guide the bead below the level of the two tongues; the tube is slit along the whole of its length, which allows passage of the flexible cover; the two ends of the tube are flared so as to facilitate slide of the slide tool on the bead; the slide tool preferably comprises a handle for maneuvering.

Various variant embodiments are possible according to the invention, namely, for example:

the section may be made so as to present a fixation on its two faces; in such a case, the outer section therefore makes four supporting surfaces and presents two guiding portions for the two slide tools; this profile envelopes two open sections each presenting two tongues;

the tongues, instead of forming part of an open section, may be made in two parts each connected to the section thanks to a groove in which the foot of the tongue is engaged;

the device may be formed by a single section, the tongues forming part thereof; the material of the tongues may be adapted to the necessary flexion, possibly thanks to an addition or an implant;

the slide tool may, in its lower portion, present a ring which makes it possible to hook a reciprocating cable; this cable passing inside the section makes it possible to handle the tool, such manoeuvre being effected either manually or being automatic as the case may be;

if it is desired to connect together two flexible structures, a single flexible section will be used, the bead, in that case, advantageously being of rectangular cross-section. In order to conserve the necessary rigidity for the supports and tongues, it may be envisaged to dispose implants perpendicularly to the length of the section, without affecting its flexibility;

the bead may possibly be connected by an advantageously flexible portion to a second bead of dimensions larger than the first. This assembly of two beads is connected to the flexible cover. The slide tool slides on the first bead, the second bead obstructing the opening of the section when the fixation is in locked position. This variant presents the advantage of ensuring perfect tightness, which avoids soiling the interior of the section. Moreover, if the second bead is reinforced with an incompressible core, the fixation in locked position will not be accessible for attempts at opening (for example downward flexion of one of the tongues by a screwdriver or the like). The slide tool sealed in locked position guarantees inviolability of the fixation. Such security enables the device of the invention to be used in accordance with the standards required in international road transport for example.

BRIEF DESCRIPTION OF THE DRAWINGS

The invention will be more readily understood on reading the following description with reference to the accompanying drawings, in which.

Figure 11A:
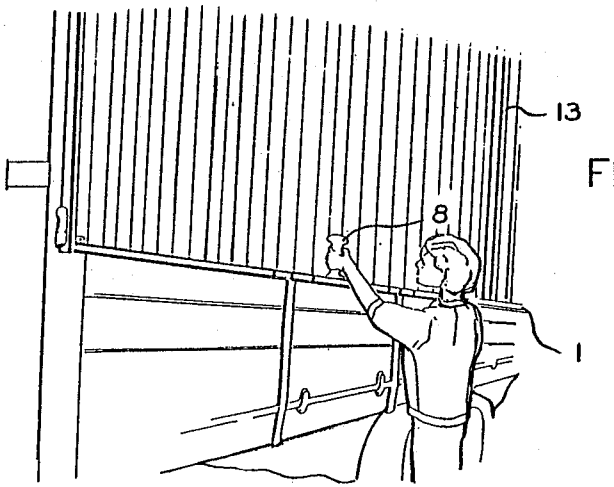
FIGS. 11*a*, 11*b*, 11*c*, 12 and 13 illustrate different types of application of a device according to the invention, namely.
Figure 11B:
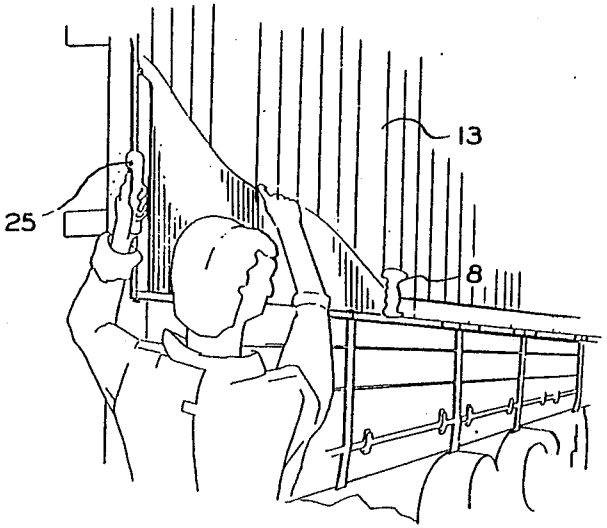
Figure 11C:
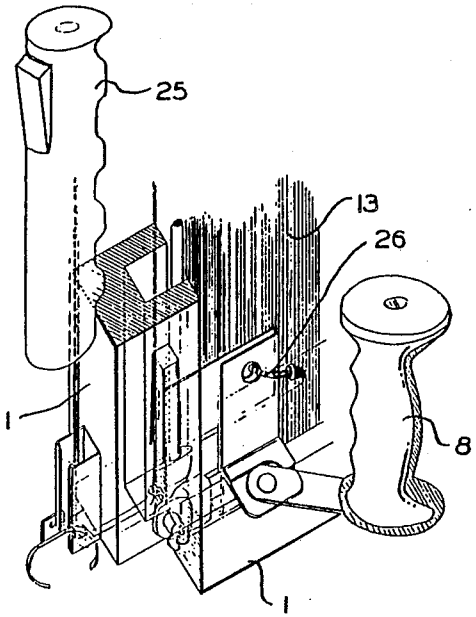
Figure 12:
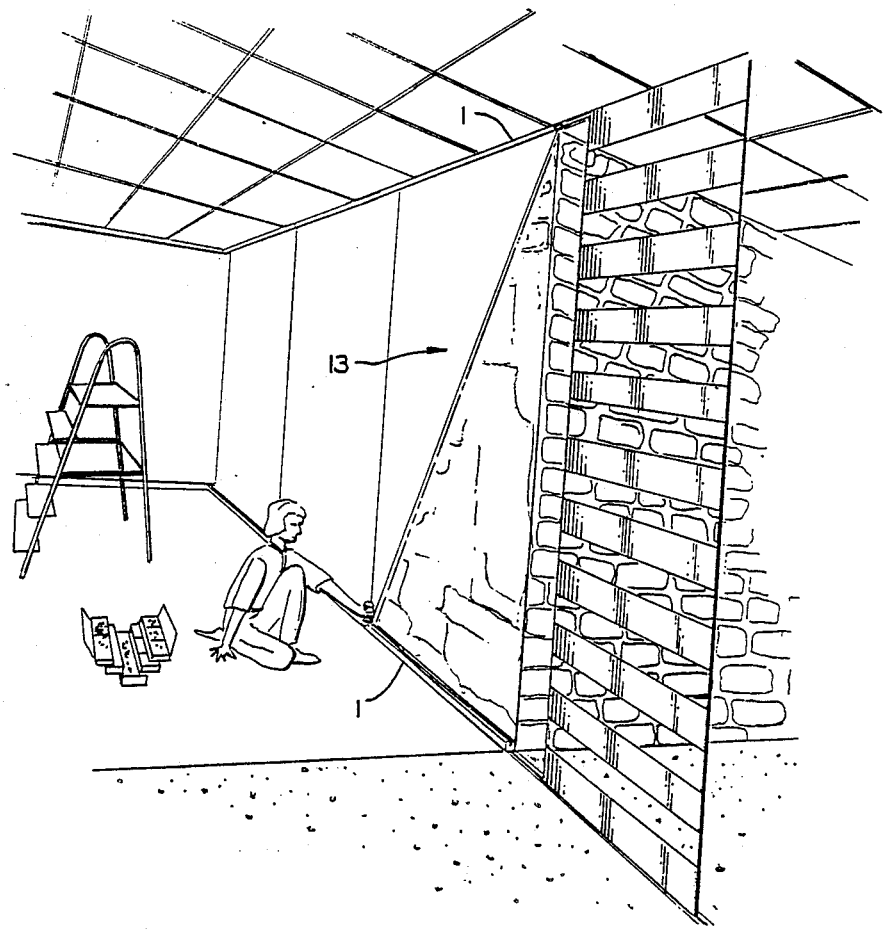
Figure 13:
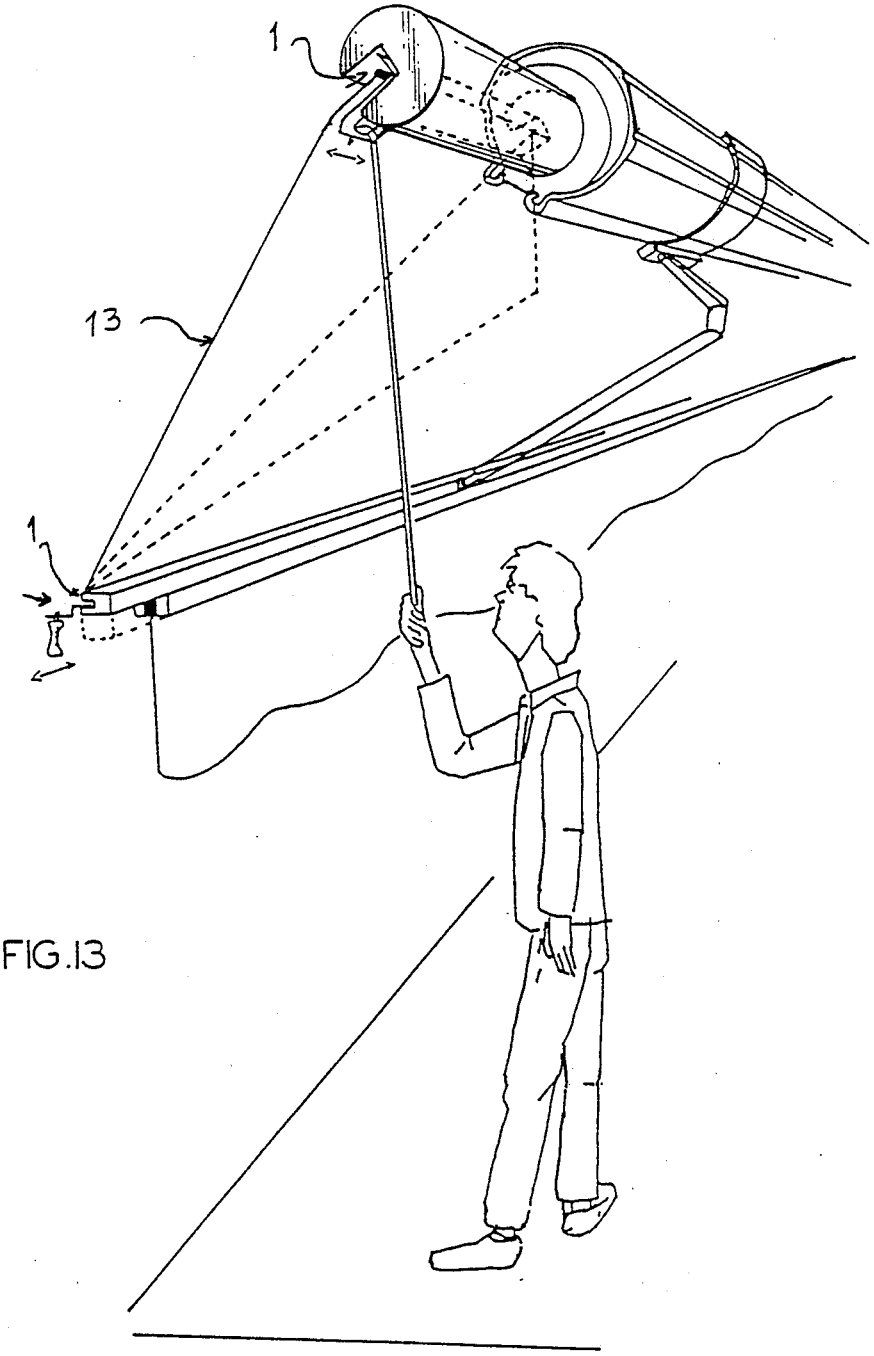

for FIGS. 11*a* to 11*c*, the use of such a device in the case of covering a lorry with a tarpaulin, for FIG. 12, use for a wall covering made of textile fabric, and for FIG. 13, use for a blind.

DETAILED DESCRIPTION OF THE DRAWINGS

Figure 1:
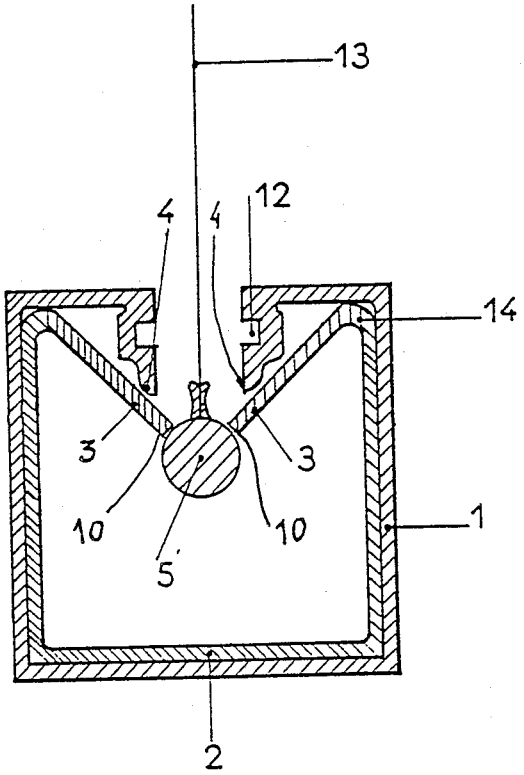
FIG. 1 shows, in front-view section, the two sections as well as the bead and the cover in locked position.

Referring now to the drawings, the device shown in FIG. 1 comprises a section 1, which is open and of advantageously square cross-section. This section envelopes another section 2 which presents two possibly symmetrical tongues 3 which abut on the portions 4 of section 1. The tongues 3 leave between their ends a gap of width less than the diameter of the bead 5. In the case of a descending vertical action on the tongues 3, the latter bend over the whole of their length. The bend 14 of the section 2 may be assimilated in practice to a rigid fixing. The possible flexion for the tongues 3 must be sufficient to allow passage of the bead 5 between the two tongues 3. In the case of an ascending vertical action resulting from an action exerted on the flexible cover 13, the tongues 3 abut on the portions 4. This additional abutment positioned near the end of the tongues 3 prevents the latter from taking a considerable flexion. This results in the bead 5 being maintained locked by the tongues 3.

Figure 2:
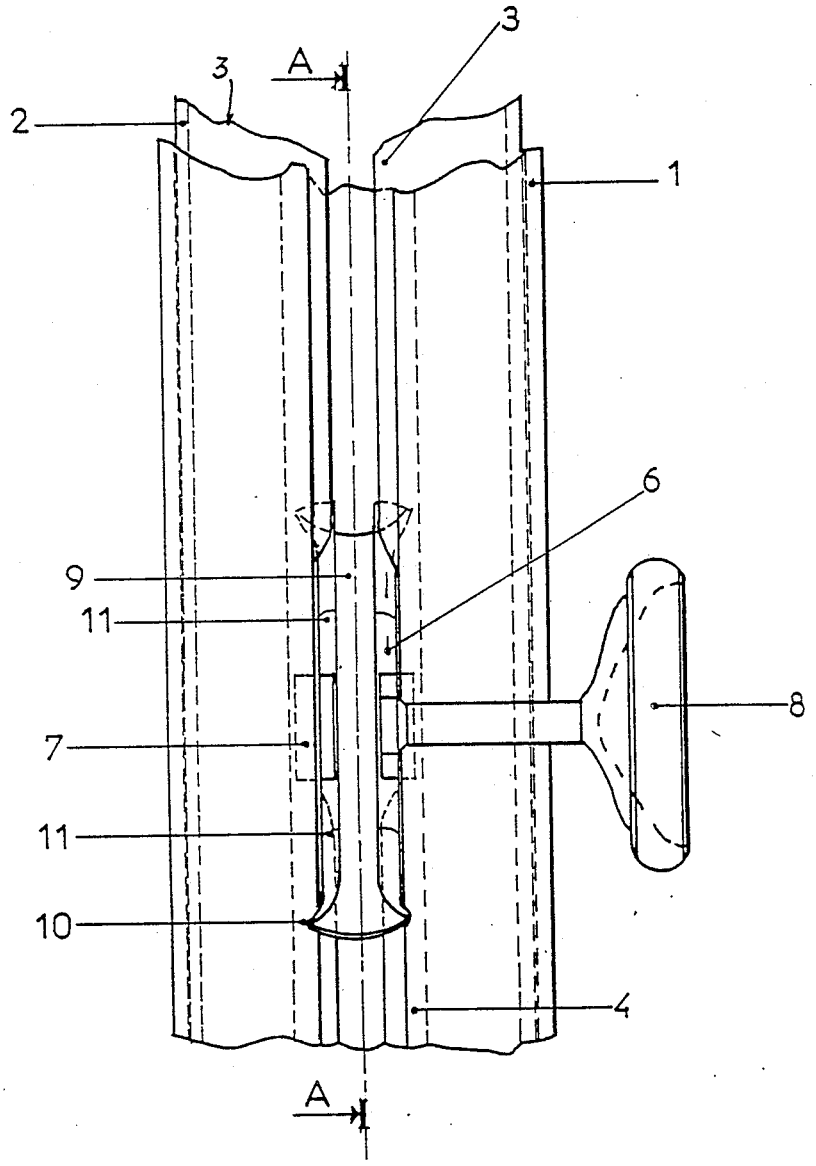
FIG. 2 shows the device according to the invention: seen from above, the slide tool being shown in this view.

FIG. 2 shows the slide tool engaged in the section 1. The slide tool is composed of the following elements: a tube 6 bent in portions 11 thereof, the flared, ends 10 of the tube, the guiding surface 7 and the handle 8.

Figure 3:
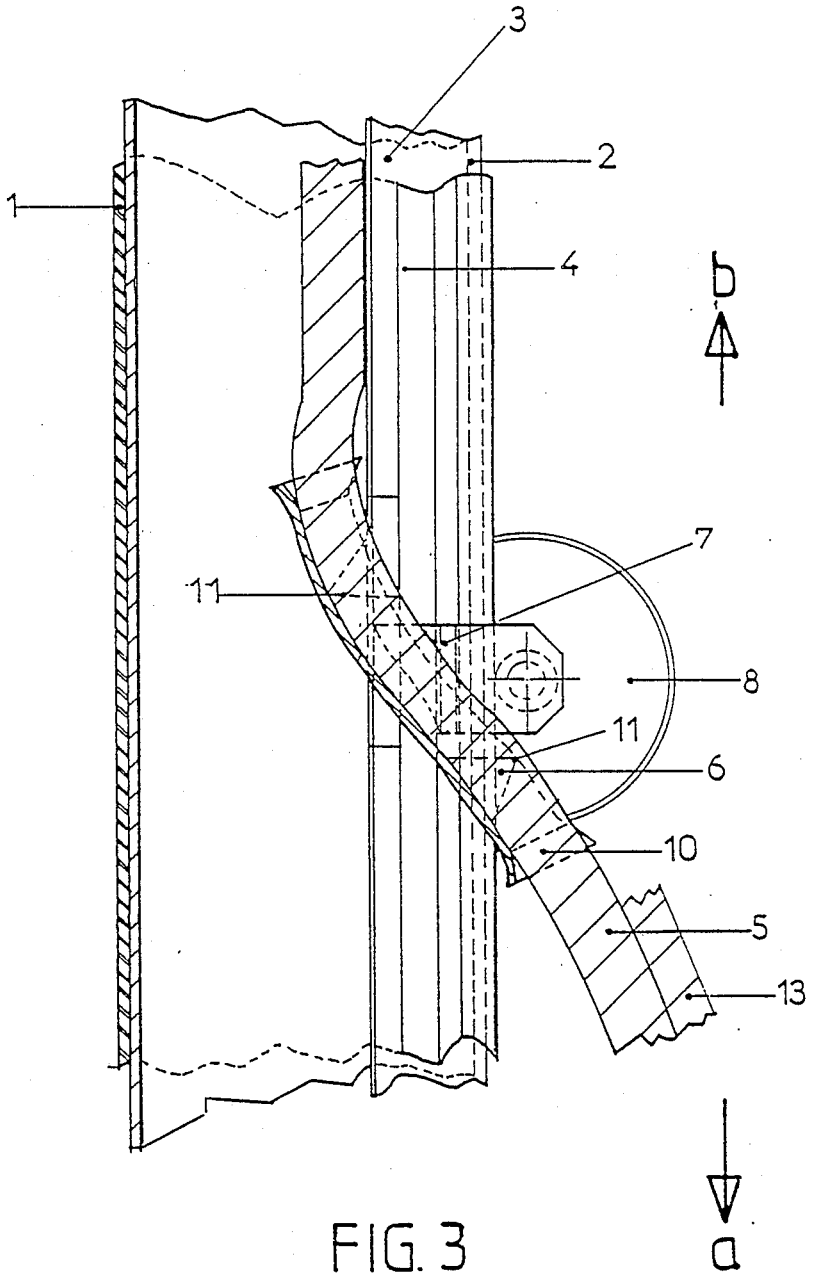
FIG. 3 shows the device according to the invention seen in longitudinal section AA, the slide tool being shown in this view.

FIG. 3 illustrates the operation of the device: the slide tool is guided by two flat portions 7 sliding in grooves 12 in the section 1. The outer diameter of tube 6 of the slide tool is adjusted so as to pass in the opening of the section 1 constituted by the two outer walls of the supports 4. The slide tool, bent in the two portions 11, guides the bead 5 below the level of the tongues 3. Due to its outer diameter, the slide tool causes the downward flexion of the tongues 3. The bent portion of the tongues 3 is of the order of some centimetres around the position of the tool. This bent portion will have a displacement induced by the displacement of the slide tool. The slide tool possesses in its upper part a groove 9 which allows passage of the flexible cover 13. The slide tool is connected to the handle 8 which enables said tool to be manoeuvred. A translation in direction A of the slide tool will cause locking of an additional portion of the flexible cover 13. A translation in direction B of the slide tool will cause unlocking of the flexible cover 13.

The ends 10 of the bent tube 6 are flared so as to facilitate slide of the slide tool on the bead 5.

Figure 4:
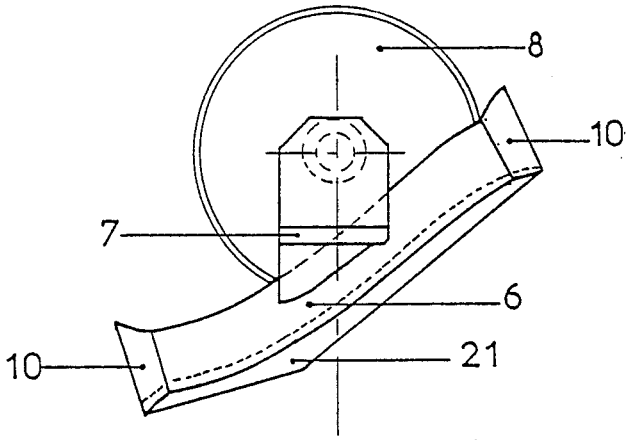
FIG. 4 shows the slide tool in side view.
Figure 5:
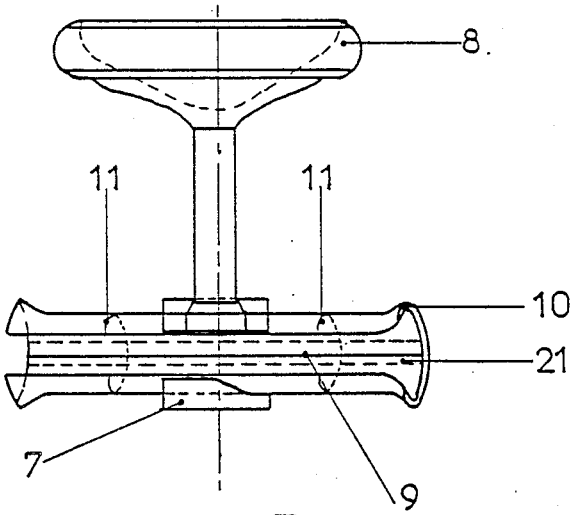
FIG. 5 shows the slide tool in plan view.
Figure 6:
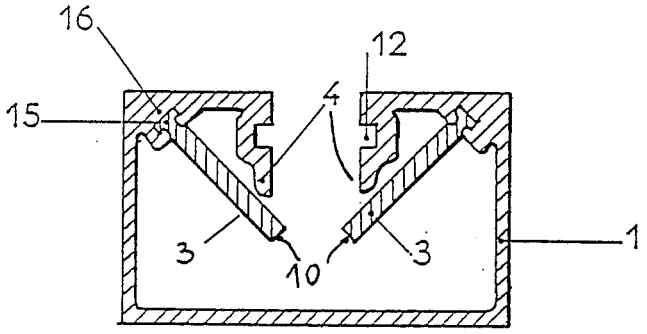
FIG. 6 shows, in front-view section, a variant of this device. The two tongues no longer form part of a second open section but are fitted in the metal section thanks to two appropriate grooves.

The slide tool, in its embodiment according to FIG. 4, may be made in two parts, obtained by example by moulding. These two parts, constituted by the two halves located on either side of the axis of symmetry of the bent tube 6, are welded on each other thanks to the flat surfaces 21.

Figure 7:
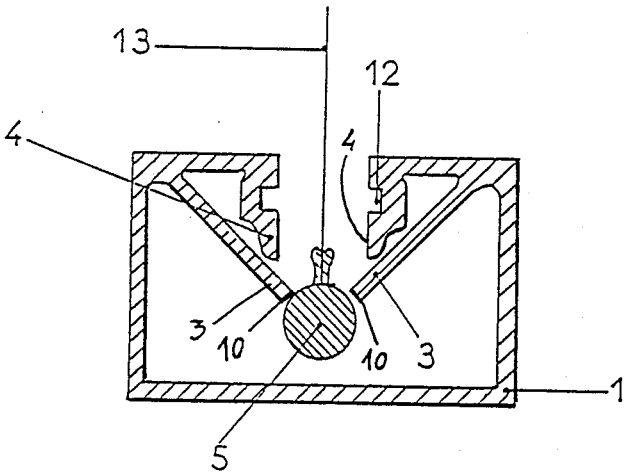
FIG. 7 shows, in front-view section, a variant of this device: the section is made in one piece, the tongues forming part thereof. The optimum rigidity of the tongues may be obtained thanks to implants.

In the embodiment of FIG. 7, the device is composed of a single section 1, the tongues 3 forming an integral part of this section. The necessary flexibility of the tongues 3 may be rendered optimum by an addition or an implant.

Figure 8:
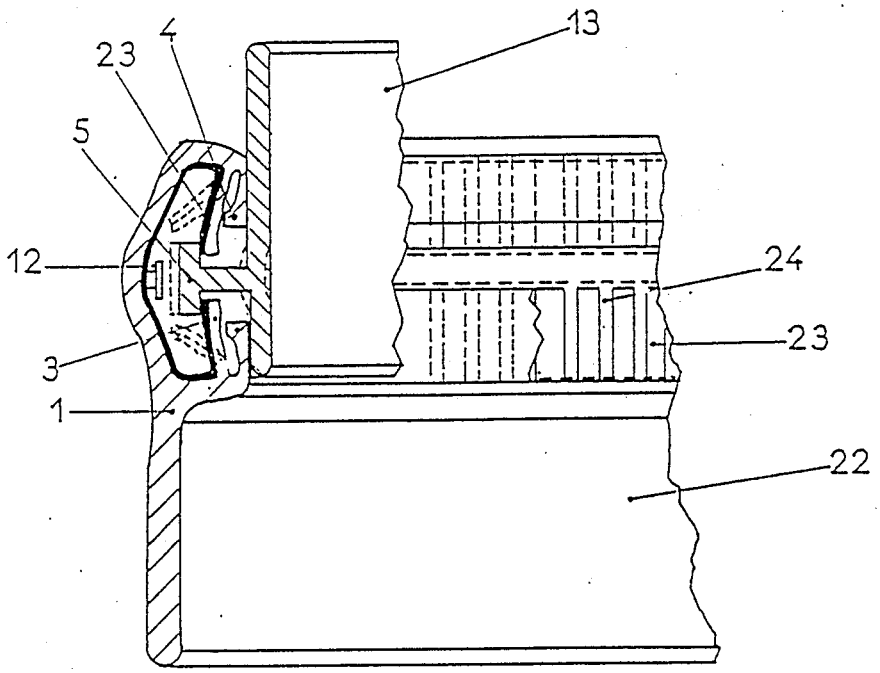
FIG. 8 shows, in front-view section, a variant of this device formed by a single flexible section.

In the embodiment of FIG. 8, the single section 1 is characterized in that it is constituted by a flexible material which may be connected to a second flexible cover via the strip 22.

The first flexible cover 13 is connected to the bead 5, advantageously of rectangular crosssection in order to be more compact.

In order to optimalize the rigidity of the tongues 3, an insert 23 may advantageously be added. In order not to compromise the suppleness of the section 1, this insert 23 is constituted by a series of tongues, only connected together by a central reinforcement 12 which may moreover constitute the surfaces for guiding the slide tool. The tongues of the insert 23 therefore leave a space 24 therebetween, which effectively makes it possible to maintain the characteristic of suppleness of section 1. This arrangement therefore makes it possible to effect fixation to each other of two flexible covers.

Figure 9:
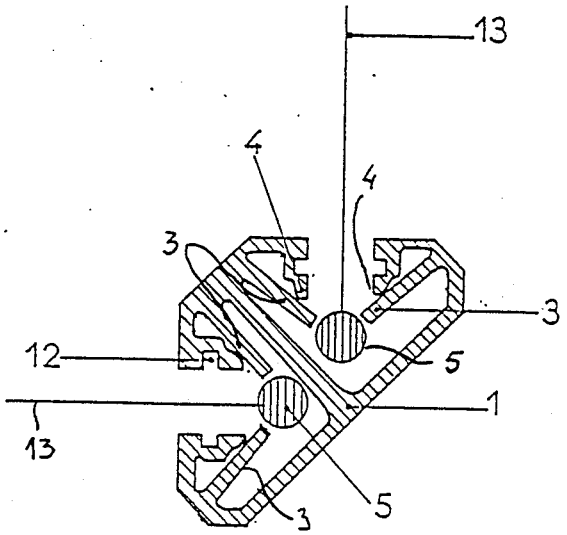
FIG. 9 shows in front-view section a variant of this device formed by a single section presenting a fixation on two of its faces.

In the embodiment according to FIG. 9, the device is constituted by a single section 1, comprising the elements necessary for any angular assembly of the two flexible covers. It is composed of two covers formed by the walls 4. The walls 4 also provide the supports which prevent the four tongues 3 from bending in the case of action on the two flexible covers 13. This arrangement makes it possible to obtain a good compactness. This embodiment of the device is particularly intended for use in big tops, camping tents and temporary shelters.

Figure 10:
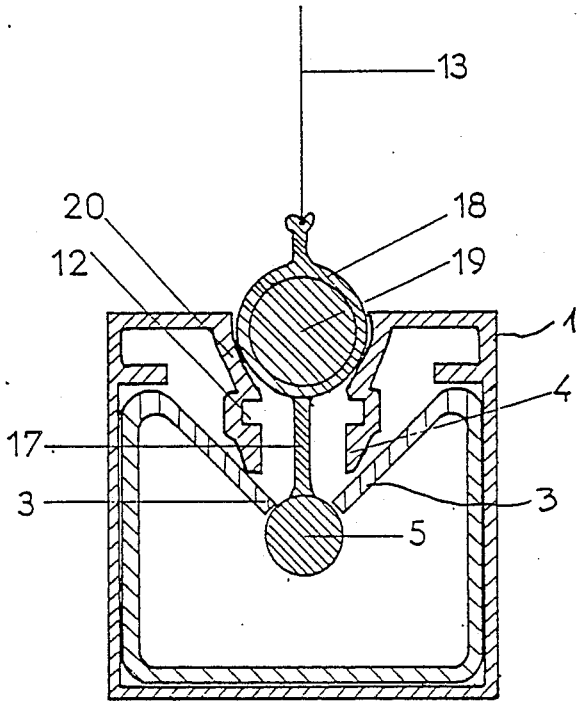
FIG. 10 shows in front-view section a variant of this device using a double bead.

In the embodiment of FIG. 10, the bead 5 lies in line with a bead 18 of diameter larger than the first bead, via an advantageously flexible portion 17. This bead 18, the fixation being in locked position, obstructs the groove of the section 1, this groove being made by the two concave walls 20 of the section 1. This arrangement guarantees that no object can be used to bend the tongues 3 downwardly in order to unlock the fixation. In fact, the bead 18 comprises an incompressible core 19 which prevents the insertion of any object between the bead 18 and the wall 20. In addition, this arrangement makes it possible to prevent soiling the interior of the section 1. The advantageously flexible portion 17, connecting the two beads 5 and 18, presents a certain characteristic of elasticity, which enables the slide tool, during an unlocking manoeuvre, to release the bead 5 downwardly in order to allow flexion of the tongues 3.

This embodiment of the device is particularly intended for use in which inviolability of the fixation is imperative. Such inviolability will then be guaranteed by sealing by lead the slide tool, rejected at one end of the section. Sheeting in international road transport constitutes one of the domains of application of this variant embodiment as shown in FIGS. 11*a* to 11*c*. In such an application, the flexible structure 13 is constituted by the tarpaulin, for example lateral, and comprises at its ends beads 5 (not shown). The gutter in the form of a section 1 is disposed along the side panel of the lorry and along the vertical uprights. Positioning and removal of the tarpaulin is also obtained by means of a slide element movable in gutters. When it is question of uncovering a vertical portion (FIG. 11*b*) in order to handle the slide tool, the latter is preferably connected to a cable that the reciprocating handle 25 moves, which makes it possible to uncover the lorry, whilst remaining on the ground. FIG 11*c* is a view in detail showing the position of the horizontal gutter and of the vertical gutter, both referenced by the same general reference 1 and in which are fitted the bead provided on the periphery of the cover 13. In this FIG. 11*c*, the two slide tools 8 and 25 are shown in locked position, a lead seal 26 being adapted to be provided to connect these tools, thus guaranteeing inviolability, for example in the case of the device described in FIG. 10.

FIG. 12 illustrates a form of application of the device according to the invention for a wall covering likewise designated by reference 13. In this case, a bead 5 is provided at each of the ends of the covering 13. The sections 1 are previously positioned at the top and bottom of the surface to be covered. For positioning the covering 13, the operator firstly inserts the upper part of the hanging, the slide tool allowing introduction of the bead being of course removed after positioning, and being used for the two portions.

FIG. 13 illustrates the use of the device according to the invention in the case of a blind 13. In such a case, the two ends of the blind 13 will be provided with a bead according to the invention capable of being introduced inside a gutter fixed, for its part, on the one hand in the upper winding system and, on the other hand, in the lower part of the blinds. Such an embodiment enables the blind to be easily removed, for example for the purpose of cleaning it, and replaced in position.

The device according to the invention presents numerous advantages over the prior art solutions, and may be used in numerous domains, among which the following may be mentioned:

covering with tarpaulins in general and in particular of road and railway vehicles equipped with flexible covering elements;

removable equipment used in numerous domains such as market gardening and horticulture;

rapid fixation of canopies and canvas added to camping, caravanning and open-air leisure equipment;

rapid assembly of structures such as big tops, temporary shelters;

fixation of canvas used for blinds and shop windows;

fixation of wall hangings in order to create removable decorations;

applications to garments in the case of the variant constituted by a flexible section;

the hermetic closure of various packings, in the case of the variant constituted by a single flexible section.

Of course, the invention is not limited to the embodiments given hereinabove. For example, it might be envisaged with the device according to the invention to connect the ends of structures which are not flat but which are bent or form complex curves.

Furthermore, although in the embodiment described hereinbefore two tongues for stopping the bead are provided inside the gutter, it might be envisaged, particularly in the event of it being desired to increase the tensile strength, to provide an assembly comprising a superposition of such tongues, the end of the supple structure comprising an equal number of parallel beads.

What is claimed is:

1. Apparatus for temporarily connecting two structures, one of which is flexible, that includes a rigid elongated housing disposed along the length of a structure, said housing having an opening in one wall thereof, a bead contained along a length of a flexible structure that is adapted to be introduced into said rigid housing through the opening, said rigid housing containing therein two tongues aligned along said opening between which is formed a gap that is smaller than the thickness of the bead, said tongues being flexible so that their gap forming ends can be moved away from each other to widen the gap when the tongues are pressured in one direction away from said opening, stop means mounted in the housing to prevent movement of the tongues in an opposite direction toward said opening to prevent widening of the gap when the tongues are pressured in said opposite direction, a slide means movable along the housing that has an envelope that partially encloses the bead and permits the bead to pass through the envelope as the slide moves along the rigid housing, said slide means being arranged to pressure the tongues in said one direction to open the gap sufficiently to permit the bead to be introduced below the tongues into said rigid housing as the slide member is moved along the rigid housing in a first direction thereby connecting the two structures, and removing the bead from beneath the tongues and out of the rigid housing as the slide member is moved in a second direction to disconnect the two structures.

2. The apparatus of claim 1 wherein said slide means is mounted in a track formed in said rigid housing, and the envelope of the slide means is a bent tube that passes between the tongue members to open the gap and has one or more guide means connected thereto for directing said bead through the gap.

3. The apparatus of claim 2 wherein said bent tube has flared ends to facilitate passage of the bead through said slide means.

4. The apparatus of claim 1 that further includes a second bead disposed over the first bead and connected thereto, said second bead being larger than said opening and being arranged to close the opening when the first bead is positioned beneath the tongues to lock the structures securely together.

5. The apparatus of claim 1 wherein the tongues form an angle of 90° with each other.

6. The apparatus of claim 1 wherein said bead is fixed to the border of the flexible structure and is cylindrical in form.

7. The apparatus of claim 6 wherein said tongues are symmetrically positioned within the housing to provide over their entire length a continuous gap that is smaller than the diameter of said bead.

8. The apparatus of claim 1 wherein said bead is fixed to the border of the flexible structure and is rectangular in form.

9. The apparatus of claim 1 further including an insert means disposed along the top opening in the rigid housing to provide rigidity to said stop means.

* * * * *